US005823848A

United States Patent [19]

Cummings

[11] Patent Number: 5,823,848

[45] Date of Patent: Oct. 20, 1998

[54] TOY AUTO RACING POWER SHIFTER AND CAR

[76] Inventor: Charles Cummings, 5719 Thomaridge Ct., Cincinnati, Ohio 45248

[21] Appl. No.: 857,591

[22] Filed: May 16, 1997

[51] Int. Cl.[6] ..... A63H 29/20

[52] U.S. Cl. ..... 446/429; 446/462; 446/484

[58] Field of Search ..... 446/429, 430, 446/484, 462; 463/64, 61, 58

[56] References Cited

U.S. PATENT DOCUMENTS

| | | | |
|---|---|---|---|
| 3,783,550 | 1/1974 | Andrews | 446/484 |
| 3,803,756 | 4/1974 | Stongin | 446/429 |
| 3,886,682 | 6/1975 | Ieda et al. | 446/429 |

FOREIGN PATENT DOCUMENTS

| | | | |
|---|---|---|---|
| 828511 | 1/1952 | Germany | 446/429 |

*Primary Examiner*—Robert A. Hafer
*Assistant Examiner*—Jeffrey D. Carlson
*Attorney, Agent, or Firm*—Jonathan E. Grant

[57] ABSTRACT

The present invention proposes a toy vehicle powered and propelled by a launching device. More specifically, the invention includes a toy vehicle, preferably about three inches long, with a flywheel at its midpoint. The body, chassis, wheel and other parts are preferably plastic. The flywheel, however, is preferably a non-ferrous metal, and most preferably a diecast zinc metal. In one embodiment of the invention, the toy vehicle is placed in the launching device. The vehicle rolls down a ramp to a car stop. Magnets in the flywheel activate a switch that turns on an electromagnet, causing the flywheel to accelerate. When the vehicle reaches the vehicle stop of the launcher, the flywheel is spinning and magnets on the flywheel activate a reed switch that turns on an electromagnet each time a magnet passes the reed switch. The reed switch, acting as a commutator along with the magnets in the flywheel, creates the effect of a D.C. motor. When the shifter is moved into a specific gear setting, preferably fourth gear, the vehicle stop is lowered and the vehicle accelerates off the ramp.

11 Claims, 6 Drawing Sheets

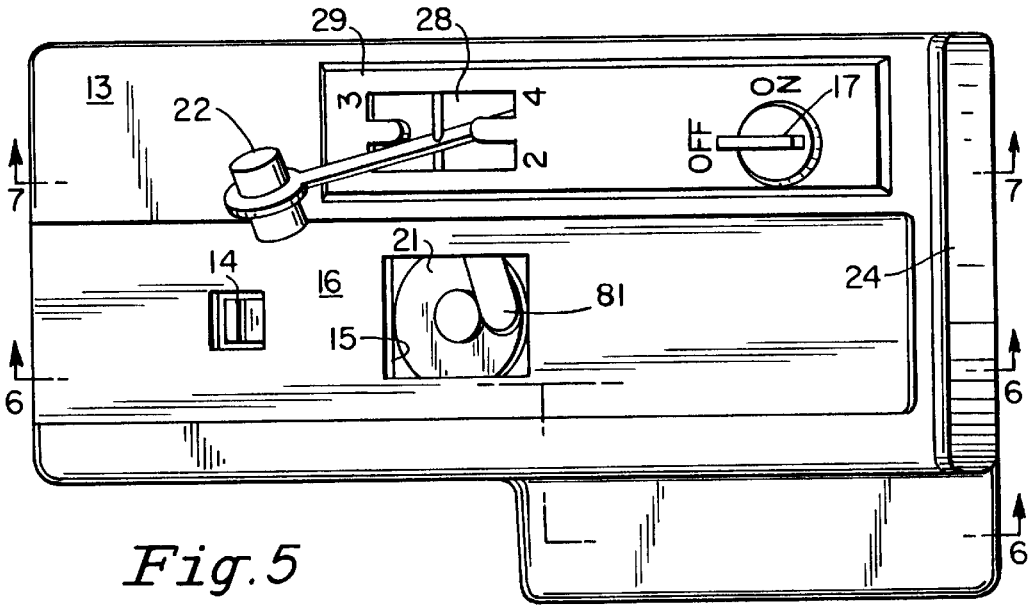
Fig.5
Fig.6
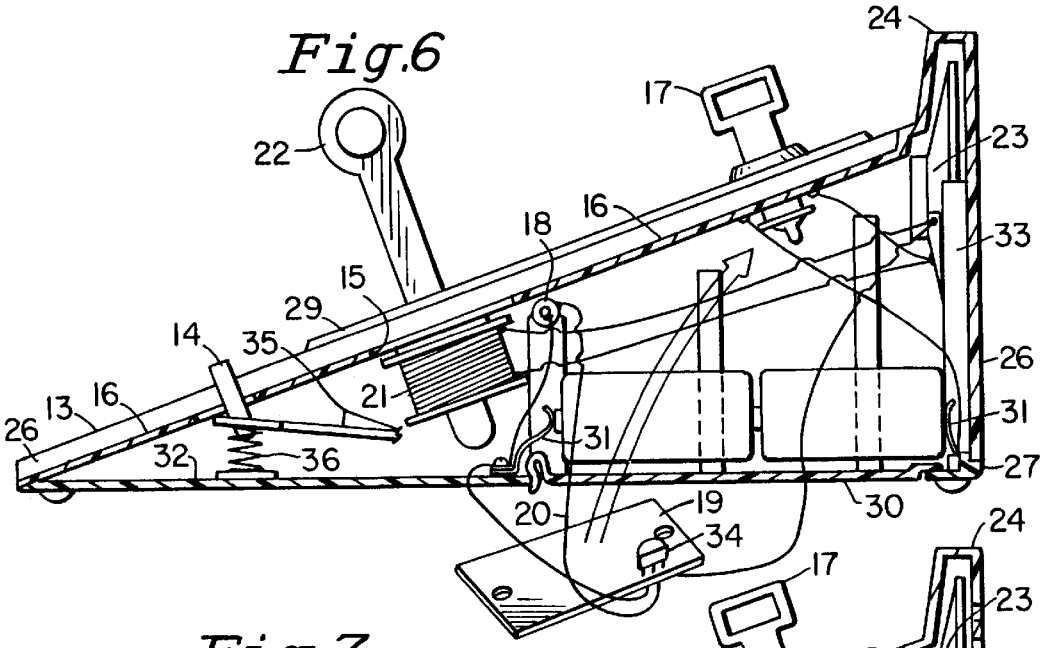
Fig.7
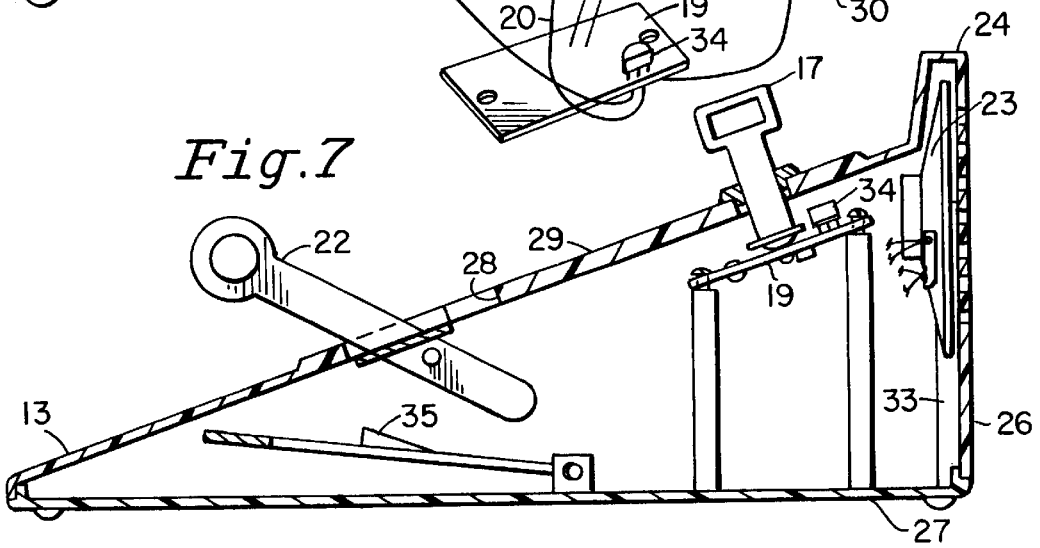

TOY AUTO RACING POWER SHIFTER AND CAR

BACKGROUND OF THE INVENTION

1. Field of the Invention

The present invention discloses a toy vehicle and a launching device.

2. Description of the Prior Art

Over the years, a number of toys have been invented to allow children and hobbyists to race miniature vehicles at relatively high speeds, using a starting block having a gear shift mechanism.

U.S. Pat. No. 3,803,756 (Stongin) discloses a toy vehicle and launching device that includes a platform on which the toy vehicle is received and a motor is interconnected to a flywheel of the toy vehicle to a clutch member. The motor rotates the flywheel while the toy vehicle is in a stationary position to store rotating inertial energy therein. When the motor is disconnected from the flywheel drive, the flywheel is simultaneously moved into an engagement with the platform. The rotating inertial energy stored in the flywheel causes the vehicle to be propelled forward from the platform at an accelerated speed. This device actually has two flywheels. One of the flywheels is in the motor rotor and the other flywheel is in the toy vehicle, propelling the vehicle.

U.S. Pat. No. 3,886,682 (Ieda et al.) discloses a vehicle and launcher which includes a hollow bodied vehicle having front and rear ground engagable wheels, with a flywheel motor mounted in the body in driving engagement with a rear drive wheel of the vehicle. A rotary drive member is mounted in the body and operatively connected to the flywheel to rotate the flywheel when the drive member is rotated. The launcher consists of a base including means for supporting the vehicle body with its drive wheel in an elevated position out of engagement with the base and at a higher level than the front wheels of the vehicle, and a rotatable drive means that simultaneously rotates the drive member in the vehicle and holds the vehicle on the base in its elevated position during the rotation. The drive means is adapted to automatically release the vehicle when the drive to the vehicle drive member is stopped so that when the flywheel is energized the vehicle is automatically released.

SUMMARY OF THE INVENTION

The present invention proposes a toy vehicle powered and propelled by a launching device. More specifically, the invention comprises a toy vehicle, preferably about three inches long, with a flywheel at its midpoint. The body, chassis, wheel and other parts are preferably plastic. The flywheel, however, is preferably a non-ferrous metal, and most preferably a diecast zinc metal. In a preferred embodiment of the invention, three plastic magnets are evenly spaced around the periphery of the flywheel.

One embodiment of the invention has an electronic power shifter comprising an outer casing having a top case and a bottom case, preferably a key operated off/on switch, an electromagnetic coil, batteries, and a car stop and release blade, which is raised and lowered by the movement of the gear shift.

In one embodiment of the invention, the toy vehicle is placed in the launching device. The vehicle rolls down a ramp to a car stop. Magnets in the flywheel activate a switch that turns on an electromagnet, causing the flywheel to accelerate. When the vehicle reaches the vehicle stop of the launcher, the flywheel is spinning and magnets on the flywheel activate a reed switch that turns on an electromagnet each time a magnet passes the reed switch. The reed switch, acting as a commutator along with the magnets in the flywheel, creates the effect of a D.C. motor. The flywheel may accelerate to well over 20,000 rpms in just 10 seconds. When the shifter is moved into a specific gear setting, preferably fourth gear, the vehicle stop is lowered and the vehicle accelerates off the ramp.

In another embodiment of the invention, the power shifter launcher comprises a speaker connected to a circuit board which amplifies and simulates the shifting noises of an automobile. A gear shift in the launcher allows the speed of a spinning flywheel positioned inside the toy vehicle to be varied. More specifically, the shifting of the gear shift raises and lowers the car stop and release mechanism, which slows the rotation of the flywheel. As the gear shift 22 is shifted from gear 1 to gear 2 and then from gear 2 to gear 3, a distal end 81 of a shifter blade 80 touches the flywheel 8 as the car resides in the grooved area, thus slowing down the flywheel 8 as the distal end 81 touches the flywheel.

In yet another embodiment of the invention, a Hall effect transistor is used in place of the Reed Switch.

In yet a further embodiment of the invention, a mechanical switch is used in place of the reed switch.

BRIEF DESCRIPTION OF THE DRAWINGS

FIG. 5 is an overhead view of the power shifter;

FIG. 6 is a cross sectional side view of the power shifter;

FIG. 7 is another cross sectional view of the power shifter;

DESCRIPTION OF THE PREFERRED EMBODIMENT

Figure 1:
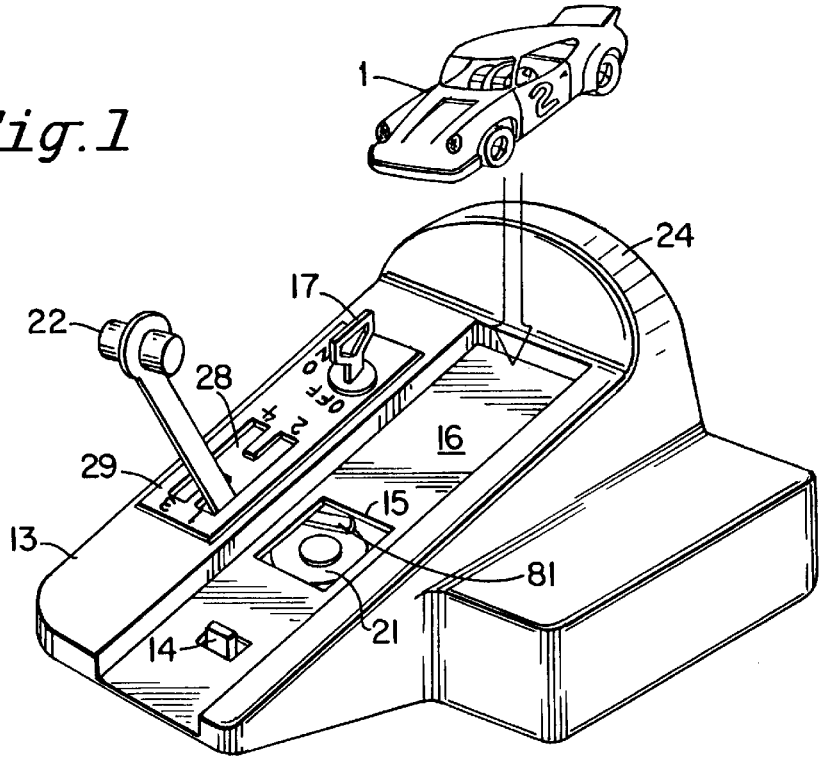
FIG. 1 is an angular view of the auto racing kit.
Figure 2:
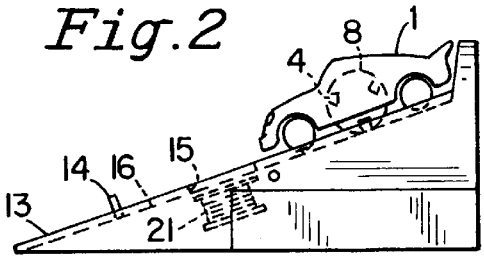
FIG. 2 is a side view of the auto racing kit.
Figure 3:
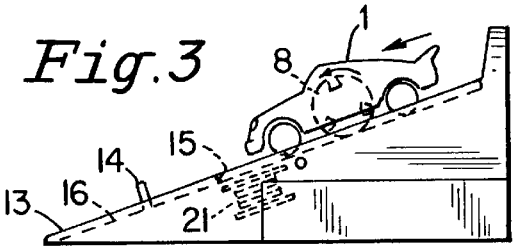
FIG. 3 is another side view of the auto racing kit as the vehicle travels down the ramp.
Figure 4:
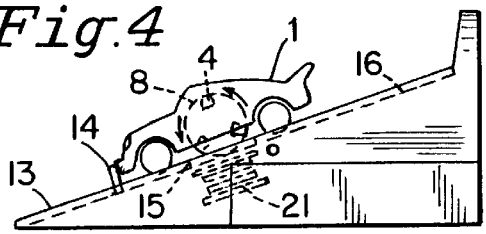
FIG. 4 is another side view of the auto racing kit as the vehicle comes to rest at the vehicle stop.
Figure 8:
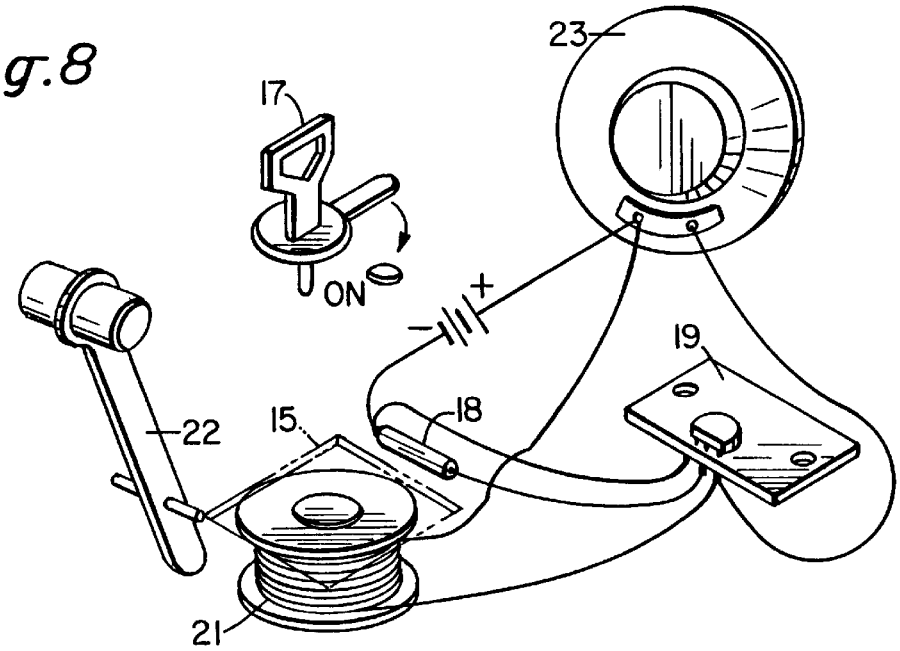
FIG. 8 is a cutaway view showing the electronic connections of the power shifter.
Figure 9:
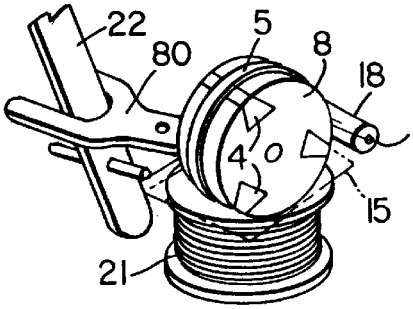
FIG. 9 is an angular view of the shifting mechanism.
Figure 10:
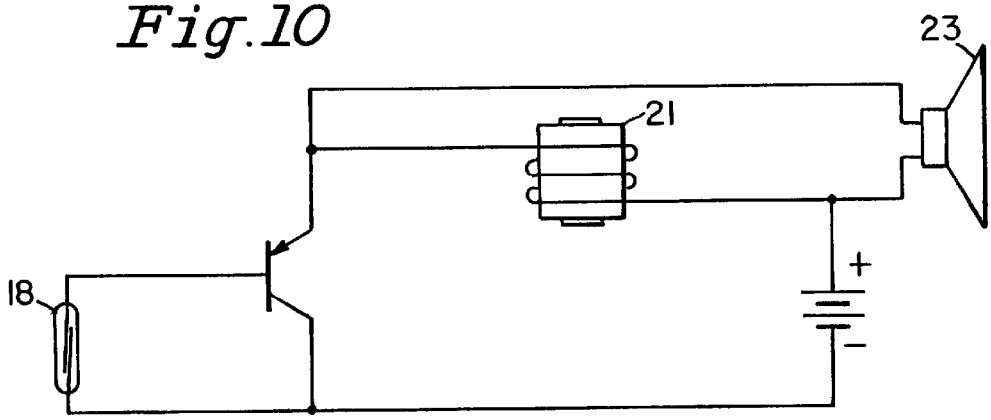
FIG. 10 is a schematic view of the circuitry of the power shifter.
Figure 11:
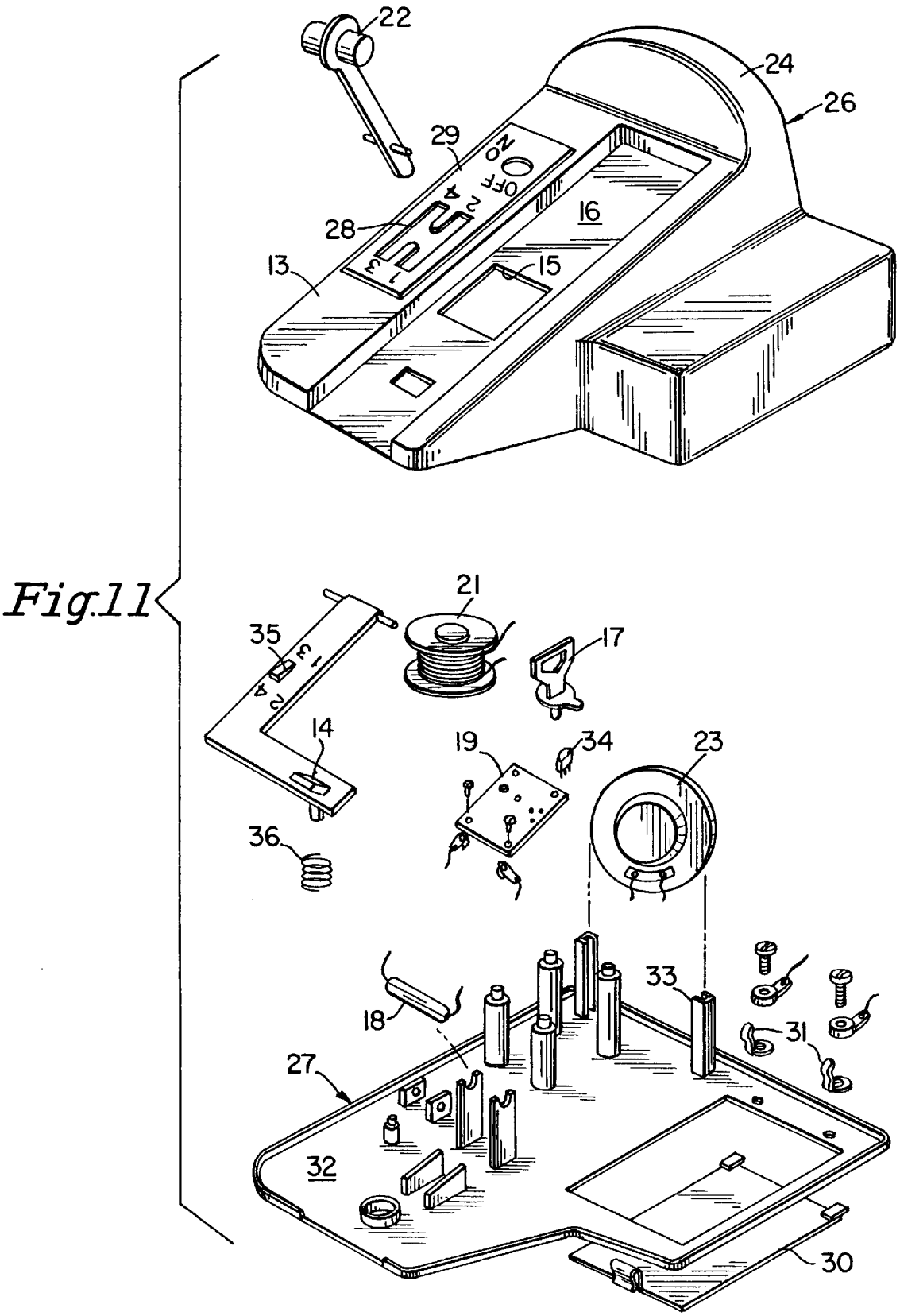
FIG. 11 is an exploded view of the power shifter.
Figure 12:
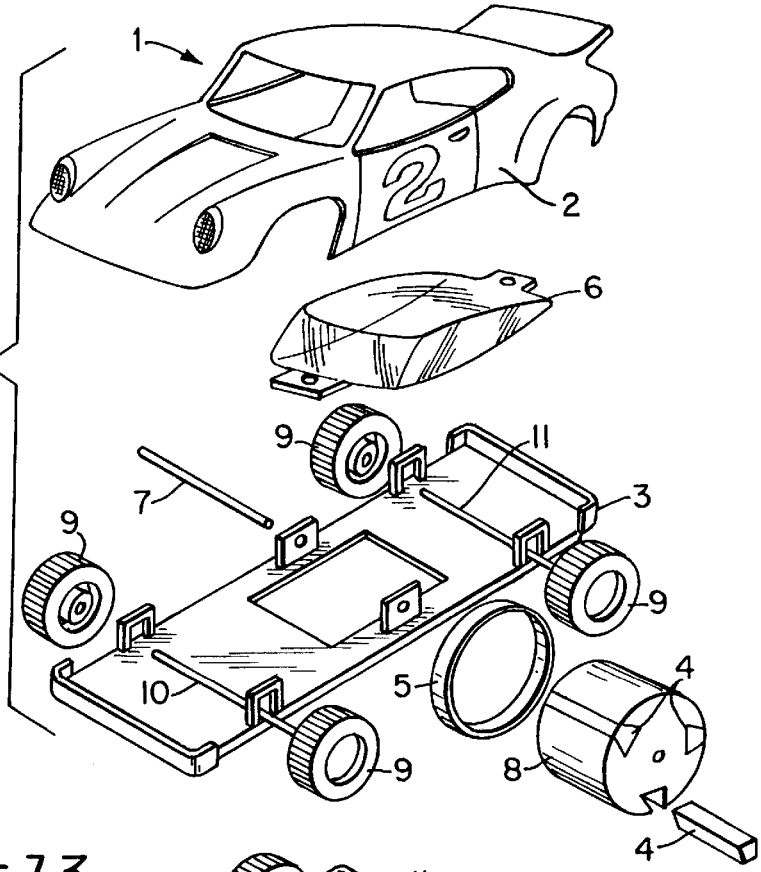
FIG. 12 is an exploded view of the toy vehicle.
Figure 13:
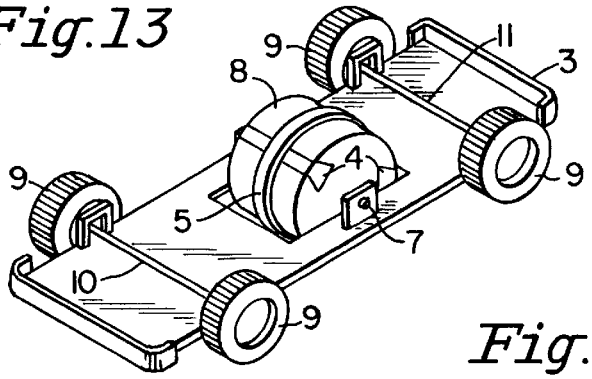
FIG. 13 is a frontal view of another embodiment of the flywheel.
Figure 15:
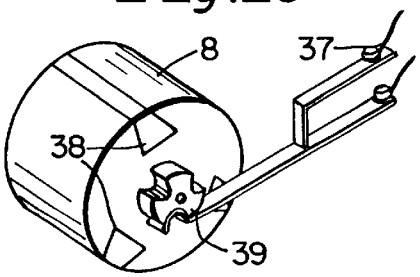
FIG. 15 is an angular view of the arrangement of the flywheel and switching mechanism.
Figure 14:
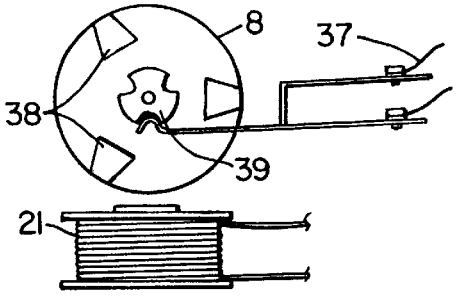
FIG. 14 is a side view of the another embodiment of the flywheel and of the electromagnet of FIG. 13.

Referring to FIGS. 1 through 15, the toy vehicle 1 is comprised of a body 2, a chassis 3, and a flywheel 8. The body 2 is preferably at least about 2 inches to about 8 inches long, but preferably about 3 to 4 inches long, having a width of one inch and a height of ¾ inch. A plurality of magnets 4 are positioned around the outer circumference of the flywheel 8. In a preferred embodiment, three plastic magnets are positioned around the flywheel 8. A flywheel axle 7 which passes through the flywheel 8 is fitted through holes 12 positioned in the chassis 3 to support the flywheel axle 7. In a preferred embodiment, a soft plastic or rubber tire 5 fits around the flywheel 8. Additionally, a front wheel axle 10 and a rear wheel axle 11 support wheels 9 on which the vehicle rolls. Preferably, a window 6 fits inside the body 2 of the vehicle 1, giving the vehicle 1 a more realistic appearance.

The vehicle is placed in a grooved area 16 on a power shifter launcher 13. The power shifter launcher 13 has a car stop 14 residimg on a car stop release plate 35 which holds the vehicle in place. The power shifter 13 may be operated by AC or, preferably, DC power, using batteries 15. It is also preferred that the power shifter 13 have an off-on switch in the form of a key switch 17. The key switch 17 is connected to another switch, preferably a reed switch 18, which is in turn connected, preferably by wires 20, to a circuit board 19. The circuit board 19 is connected to an electromagnet 21. When the key switch 17 is turned to the "on" position, and the toy vehicle 1 is sent rolling down the ramp, the flywheel 8 begins to turn. When the vehicle 1 reaches the car stop 14, the flywheel 8 is spinning, and the magnets 4 on the flywheel 8 turn on the reed switch 18. The reed switch 18 then turns on the electromagnet 21 each time a magnet passes the reed switch 18. The reed switch 18 acts as a commutator along with the magnets 4 in the flywheel 8, thereby creating the effects of a D.C. motor. The mechanism allows the flywheel 8 to accelerate to over 20,000 rpms in 10–15 seconds.

In an alternative embodiment of the invention, a Hall Effect transistor 34 replaces the reed switch. In this embodiment, when the magnets 4 in the flywheel 8 pass over the transistor 34, the magnetic coil electromagnet is turned on.

In another embodiment of the invention, a mechanical switch 37 is used in place of the reed switch. In this embodiment, the flywheel comprises iron inserts 38 instead of magnets. A cam 39 at the center of the flywheel 8 turns the switch 37 on and off. When the switch 37 is turned on, the iron inserts 38 are pulled by the electromagnet 21. The switching by the cam 39 of switch 37 allows the flywheel 8 to accelerate over 20,000 rpms in just 10 seconds. This design does not require magnets in the flywheel since there is no reed switch to activate.

Figure 16:
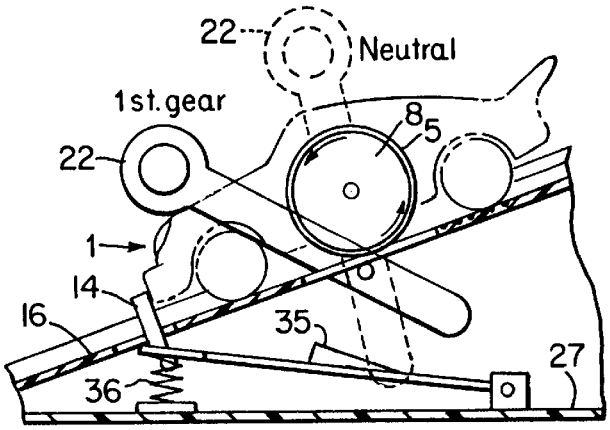
FIG. 16 is a cross sectional view of the power shifter and toy vehicle in first gear.
Figure 17:
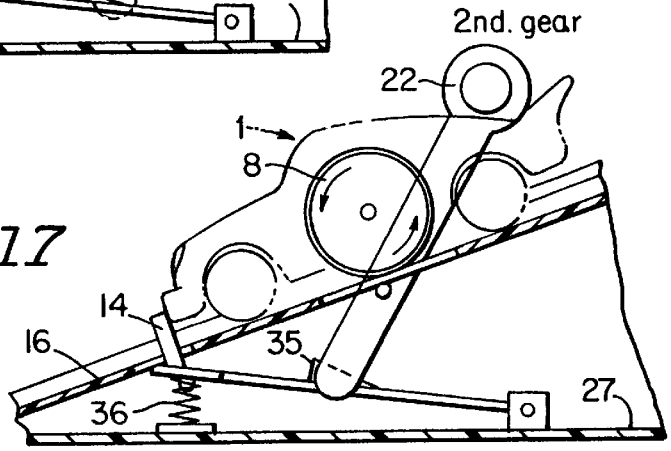
FIG. 17 is a cross sectional view of the power shifter and toy vehicle in second or third gear.
Figure 18:
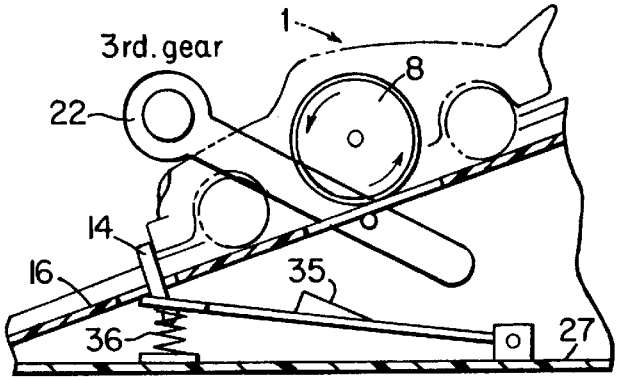
FIG. 18 is a cross sectional view of the power shifter and toy vehicle in third gear.
Figure 19:
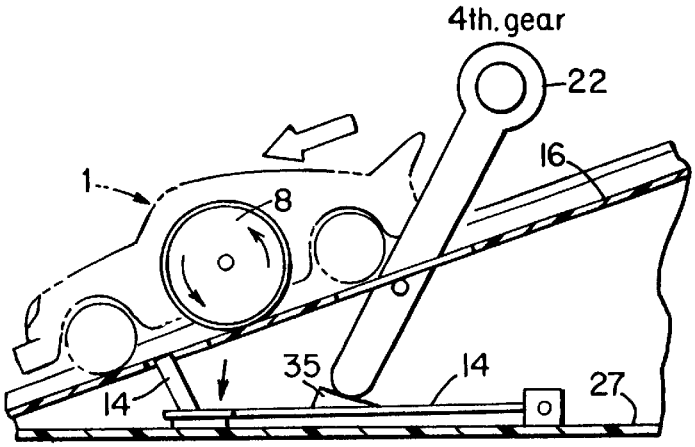
FIG. 19 is a cross-sectionview of the power shifter in fourth gear.

As shown in FIGS. 16–19, the power shifter further comprises a gear shift 22 that lowers the car stop 14 as the gear shift 22 moves from gear 1 (FIGS. 16 and 19) to gear 2 (FIG. 17) and from gear 3 (FIG. 18) to gear 4 (FIG. 19) where the car is released from the ramp. As the gear shift 22 is shifted from gear 1 to gear 2, then from gear 2 to gear 3, and then from gear 3 to gear 4, the distal end 81 of the forked arm 80 touches the flywheel 8, slowing down the flywheel 8 as it passes the electromagnet 21. As the gear shift 22 moves from gear 3 to 4 (FIGS. 18 and 19), the gear shift depresses the car stop 14 below the surface of the grooved area 16, allowing the toy vehicle 1 to accelerate down and off the ramp. In a preferred embodiment, a speaker 23 is connected to the electromagnet 21 and the circuit board 19. The circuit board may contain a microchip which reproduces the sound a racing car engine as the car shifts gears. The reed switch is also connected to the speaker 23 (via wires 20). A gear shifting sound is created each time the gear shift 22 is changed. More specifically, when the gear shift moves from gear #1 to #2, and then from 2 to 3, and from 3 to 4, the sound of a car motor shifting sound is activated as the flywheel 8 spins.

When the gear shift 22 is shifted into 4th gear, the gear shift 22 presses down on the car stop & release plate 35, thus lowering the car stop and release 14. The vehicle 1 is therein released from the vehicle launcher, and goes speeding down the ramp.

In a preferred embodiment of the invention, the power shifter has a circuit board 19, a pnp transistor 34, a speaker 23, a reed switch 18, an electromagnet 21, a switch 17, batteries 15, and wires 20. The circuit board 19 is connected by the wires 20 to the speaker 23, the electromagnet 21, and the reed switch 18. The speaker 23 is additionally connected by the wires 20 to the reed switch 18 and the electromagnet 21. Additionally, the switch 17 and batteries 15 are connected to the speaker 23 and the reed switch 18.

The mechanisms for the power shifter 13 are contained within a casing 24, with the casing having a top case 26, and a bottom case 27. The top case 24 has a gear shift opening 28 through which the gear shift 22 passes. A label 29 which labels the gears or positions of the gear shift 22 resides on top of the top case 26. The bottom case 27 has a battery door 30 and battery contacts 31 to contact and hold batteries (not shown). Residing on the top surface of the bottom case 27 is the reed switch 18, and the circuit board 19, upon which may reside either a transistor(s) or a microchip(s). Positioned between the bottom case 27 and the top case 24 and held by various brackets 33 are the speaker 23, the key switch 17, the electromagnetic coil 21, the car stop and release plate 35, and a spring 36 which communicates with both the car stop and release plate 35, and the bottom case 27.

Many modifications and variations of the present invention are possible in light of the above teachings. It is, therefore, to be understood within the scope of the appended claims the invention may be protected otherwise than as specifically described.

What is claimed is:

1. An auto racing kit, comprising:

a toy vehicle, said toy vehicle comprising wheels, and a flywheel, said flywheel of said toy vehicle further comprising a plurality of magnets at the periphery of said flywheel, said flywheel having the ability to be accelerated to power the vehicle; and an electronic power shifter for powering said toy vehicle, said electronic power shifter comprising a ramp upon which the toy vehicle is positioned, a gear shift for altering the speed at which the flywheel of said vehicle rotates, said gearshift comprising and connected to a shifter blade which touches the flywheel as the gearshift is shifted, a vehicle stop for the holding and releasing of said vehicle, an electromagnet, a reed switch, and a circuit board, such that when said vehicle rolls down said ramp of said power shifter, the vehicle stops at said vehicle stop, the flywheel continues to rotate, said reed switch is triggered everytime said magnets of said flywheel revolve, said electromagnet is turned on when said reed switch is turned on, whereupon said electromagnet causes said flywheel to rotate faster each time said electromagnet is turned on, wherein shifting the gear shift of the power shifter causes the shifter blade to touch said flywheel of said vehicle causing the flywheel to slow, and such that said vehicle is released from said power shifter by shifting said gear shift to a designated position, thereby releasing the vehicle stop from holding said vehicle in place.

2. The auto racing kit of claim 1, wherein said fly wheel of said toy vehicle is comprised of a die cast zinc.

3. The auto racing kit of claim 1, wherein said plurality of said magnets are spaced around the periphery of the flywheel.

4. The auto racing kit of claim 3, wherein said plurality of said magnets are evenly spaced around the periphery of said flywheel.

5. The auto racing kit of claim 1, wherein said power shifter further comprises a direct current power source, said direct current power source being batteries.

6. The auto racing kit of claim 1, wherein said power shifter further comprises a speaker, said speaker connected to said circuit board and said gear shift, such that when said gear shift is shifted, sound emanates from said speaker.

7. The auto racing kit of claim 5, wherein said power shifter further comprises an off-on switch.

8. The auto racing kit of claim 7, wherein said off-on switch of said power shift is a key operated switch.

9. The auto racing kit of claim 1, further comprising a speaker, a switch, batteries, and wires, wherein said circuit board is connected by said wires to said speaker, said electromagnet, and said reed switch, said speaker is additionally connected by said wires to said electromagnet, and said batteries are connected to said speaker and said reed switch.

10. An auto racing kit, comprising: a toy vehicle, said toy vehicle comprising wheels, and a flywheel, said flywheel of said toy vehicle further comprising a plurality of magnets at the periphery of said flywheel, said flywheel having the ability to be accelerated to power the vehicle; and an electronic power shifter for powering said toy vehicle, said electronic power shifter comprising a ramp upon which the toy vehicle is positioned, a gear shift for altering the speed at which the flywheel of said vehicle rotates, said gearshift comprising and connected to a shifter blade which touches the flywheel as the gearshift is shifted, a vehicle stop for the holding and releasing of said vehicle, a magnetic coil electromagnet, a Hall Effect transistor, and a circuit board, such that when said vehicle rolls down said ramp of said power shifter, the vehicle stops at said vehicle stop, the flywheel continues to rotate, said magnets of said flywheel turns said Hall Effect transistor on, and said transistor turns said magnetic coil electromagnet on, whereupon said electromagnet causes said flywheel to rotate faster each time said electromagnet is turned on, wherein shifting the gear shift of the power shifter causes the shifter blade to touch said flywheel of said vehicle causing the flywheel to slow, and such that said vehicle is released from said power shifter by shifting said gear shift to a designated position, thereby releasing the vehicle stop from holding said vehicle in place.

11. An auto racing kit, comprising: a toy vehicle, said toy vehicle comprising wheels, and a flywheel, said flywheel of said toy vehicle comprising a plurality of iron inserts at the periphery of said flywheel, said flywheel having the ability to be accelerated to power the vehicle; and an electronic power shifter for powering said toy vehicle, said electronic power shifter comprising a ramp upon which the toy vehicle is positioned, a gear shift for altering the speed at which the flywheel of said vehicle rotates, said gearshift comprising and connected to a shifter blade which touches the flywheel as the gearshift is shifted, a vehicle stop for the holding and releasing of said vehicle, an electromagnet, a mechanical off/on switch, and a circuit board, such that when said off/on switch is turned on, the mechanical switch is turned on, the electromagnet is turned on by said mechanical switch, whereupon said electromagnet causes said flywheel of said vehicle, positioned over said electromagnet, to accelerate, whereupon said electromagnet causes said flywheel to rotate faster each time said electromagnet is turned on, wherein shifting the gear shift of the power shifter causes the shifter blade to touch said flywheel of said vehicle causing the flywheel to slow, and such that said vehicle is released from said power shifter by shifting said gear shift to a designated position, thereby releasing the vehicle stop from holding said vehicle in place .

* * * * *